United States Patent [19]

Woźniczko et al.

[11] 4,325,538

[45] Apr. 20, 1982

[54] SMELTING FURNACE FOR DIRECT OBTAINING OF COPPER FROM ORE CONCENTRATES/AND COPPER ORES

[75] Inventors: Włodzimierz Woźniczko; Adam Łukasik; Józef Marczyński, all of Katowice; Witold Kowal, Głogow; Edward Plaskacewicz, Bytom; Sławomir Pasierb, Chorzow; Norbert Langner, Katowice, all of Poland

[73] Assignee: Biuro Projektow Przemyslu Metali Niezelaznych "Bipromet", Katowice, Poland

[21] Appl. No.: 107,680

[22] Filed: Dec. 27, 1979

[51] Int. Cl.[3] ..... F27B 3/24; C21B 15/04

[52] U.S. Cl. ..... 266/190; 266/286; 75/74

[58] Field of Search ..... 266/190–194, 266/241, 280–286; 75/72–76

[56] References Cited

U.S. PATENT DOCUMENTS

| | | | |
|---|---|---|---|
| 3,312,457 | 4/1967 | Schweinsberg et al. | 266/284 |
| 3,687,437 | 8/1972 | Fischer | 266/284 |
| 3,788,622 | 1/1974 | van Laar et al. | 266/192 |
| 3,820,770 | 6/1974 | Snow | 266/193 |
| 4,012,029 | 3/1977 | Sequin et al. | 266/281 |

FOREIGN PATENT DOCUMENTS

| | | | |
|---|---|---|---|
| 37-14202 | 9/1962 | Japan | 266/190 |

*Primary Examiner*—M. J. Andrews
*Attorney, Agent, or Firm*—Edwin E. Greigg

[57] ABSTRACT

The subject of the invention is a method of prevention of deep infiltration of copper into a lining of a smelting furnace for direct obtaining of copper from ore concentrates and copper ores.

The essence of the invention consists in that to the lower part of the hearth (2) of a furnace a cooling medium is delivered which is distributed in streams below a lining (1) of the furnace. Particular layers (1) of the hearth (2) have good heat conductivity, and in the lower part of the hearth (2) channels (4) are situated which serve for distribution of the cooling medium. The solution according to the invention prevents completely an excessive temperature increase of the furnace jacket.

6 Claims, 1 Drawing Figure

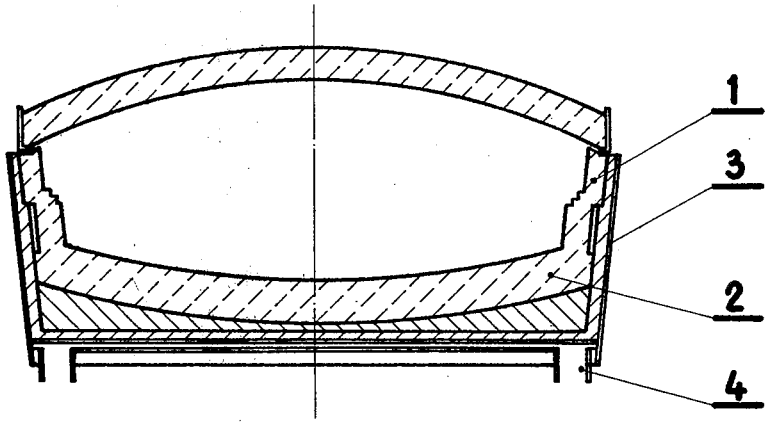
1
3
2
4

SMELTING FURNACE FOR DIRECT OBTAINING OF COPPER FROM ORE CONCENTRATES/AND COPPER ORES

A method of prevention of deep infiltration of copper into the lining of a smelting furnace for direct obtaining of copper from ore concentrates/and ores and a smelting furnace for direct obtaining of copper from one concentrates/and copper ores.

The subject of the invention is a method of prevention of deep infiltration of copper into the lining of a smelting furnace for direct obtaining of copper from ore concentrates and copper ores and a smelting furnace for direct obtaining of copper from ore concentrates and copper ores.

A known method of direct obtaining of copper from ore concentrates or copper ores is presented in the Polish Pat. Spec. No. 95510, wherein the specified method of direct obtaining of copper is carried out in a furnace whose design is presented on page 370 of the periodical Radex-Rundscheu, No. 4/5 of 1968.

The known furnace for obtaining of copper from ore concentrates or copper ores, called also a suspension roaster, consists of three principal design elements, namely, a reaction shaft, a settling tank and a gas shaft. The reaction shaft is fed with broken-up ore concentrate/and an ore and air which may be enriched with oxygen usually up to 65%, but the oxygen content should not exceed 95%. In the settling tank liquid reaction products collect, i.e. the smelt and the slag. Depending on the method according to which the reaction proceeds and on the type of the furnace charge, the smelt may be in a form of either a so-called flat, or in a form of metallic copper. In the hitherto known and applied industrial furnaces copper was not obtained in a metallic form, but only in a form of a flat. On the account of physical and chemical characteristics of the flat, the lower portion of the fire-resistant lining of the settling tank is considerably thick and consists of several layers, at least one of said layers having good insulating properties. Flat/and slag which to a certain extent infiltrate the fire-resistant lining have heat conductivity similar to that of the fire-resistant materials of the lining of the settling tank called a hearth, which contact flat-/and slag, due to which during the operation of the furnace heat conductivity of the whole hearth does not change. The quantity of heat abstracted by the lower part of the hearth is small and the temperature of the steel structure is relatively low, due to which natural cooling of the lower part of the hearth is sufficient. The problem looks quite differently at obtaining of copper in its metallic form. Such characteristics of copper as very good heat conductivity, ability of wetting the fire-resistant materials by liquid copper, especially by copper containing $0.3 \div 1.5\%$ of oxygen, and the freezing temperature of copper lower than that of the flat, cause that at the temperatures required by a technological process copper infiltrates very deeply into the lining of the hearth. The worse is heat conductivity of the hearth and the worse are the conditions of heat abstraction from the lower part of the hearth, the deeper is the infiltration. Infiltration of copper progressing into the lower layers of the hearth lining results in a considerable rise of temperatures in the hearth and in the steel structure of the hearth. Deep infiltration of copper into the hearth, at a considerable difference of weights by volume of fire-resistant materials of the hearth lining and liquid copper results in creation of considerable forces in the hearth, which may even cause a damage of the hearth.

The essence of the invention consists in that to the lower part of the hearth of a smelting furnace serving for direct obtaining of copper from ore concentrates or copper ores a cooling medium is delivered which is distributed in streams below the lining of the furnace. Particular layers of the furnace hearth have good heat conductivity, and in the lower part of the hearth channels are situated for distribution of the cooling medium.

The solution according to the invention prevents completely an excessive temperature increase of the furnace jacket.

The method according to the invention is presented by the below example.

The temperature of liquid copper in a furnace during its operation is about 1300° C., whereas the temperature under the first layer of the lining made of magnesite-chromite materials is within the range of $900° \div 1200°$ C. The temperature under the second layer of the lining made of magnesite materials is within the range of $650° \div 750°$ C., the temperature of a steel jacket of the hearth in the range of $40° \div 140°$ being obtained by treating the jacket with air. Air from a fan is delivered through a collector to a cooling system situated in the steel structure of the hearth and consisting of through-channels, the quantity of air in particular elements of the system being controlled so that the velocity of outflowing air in each channel is bigger than 1 m/sec.

A furnace for direct obtaining of copper according to the invention is shown in an example of its realisation in a drawing in its cross-section on a lining 1 of the hearth 2 of a furnace, said lining consisting of three layers, whereas the first layer is made of magnesite-chromite materials, the second layer -f magnesite materials, and the third layer - of high density chamotte materials. A steel jacket 3 of the hearth 2 of the furnace is provided with through-channels 4 via which air passes in streams.

What is claimed is:

1. A furnace for directly obtaining copper during smelting from ore concentrates and/or copper ore which comprises:

a hearth lining having an integral bottom and side wall formed of first, second and third layers of materials each having a good heat conductivity with each layer having a different resistance to heat transfer through the layer and a good resistance against any destructive action of copper and slag during a smelting process;

a metal jacket surrounding said hearth, said metal jacket including channels through which a coolant may flow;

said layers being adjacent each other with said third layer closest said metal jacket.

2. A furnace as claimed in claim 1, wherein the material of said layers of material is such that at an operation of about 1300° C. in said hearth the temperature between said first and second layer is from about 900° C. to about 1200° C., the temperature between said second and third layers is from about 650° C. and about 750° C. and the temperature between said third layer and said metal jacket is from about 40° C. to about 140° C.

3. A furnace as claimed in claim 1, wherein:

said first layer of material is made of magnesite-chromite;

said second layer is made of f-magnesite; and said third layer is made of high density chamotte.

4. A furnace as claimed in claim 2, wherein:

said first layer of material is made of magnesite-chromite;

said second layer is made of f-magnesite; and said third layer is made of high density chamotte.

5. A furnace as claimed in claim 3, wherein said jacket is made of steel.

6. A furnace as claimed in claim 4, wherein said jacket is made of steel.

* * * * *